US006247528B1

(12) United States Patent
Blomgren et al.

(10) Patent No.: US 6,247,528 B1
(45) Date of Patent: Jun. 19, 2001

(54) PLATE HEAT EXCHANGER

(75) Inventors: Ralf Blomgren, Skanör; Anders B Knutsson, Jämjö Slätt, both of (SE)

(73) Assignee: Alfa Laval AB, Tumba (SE)

( * ) Notice: Subject to any disclaimer, the term of this patent is extended or adjusted under 35 U.S.C. 154(b) by 0 days.

(21) Appl. No.: 09/424,737

(22) PCT Filed: Jun. 23, 1998

(86) PCT No.: PCT/SE98/01214

§ 371 Date: Nov. 30, 1999

§ 102(e) Date: Nov. 30, 1999

(87) PCT Pub. No.: WO98/59208

PCT Pub. Date: Dec. 30, 1998

(30) Foreign Application Priority Data

Jun. 25, 1997 (SE) ..... 9702420

(51) Int. Cl.[7] ..... F28F 9/02; F28F 3/08

(52) U.S. Cl. ..... 165/167; 165/178

(58) Field of Search ..... 165/167, 916, 165/178, 176

(56) References Cited

U.S. PATENT DOCUMENTS

| | | | | |
|---|---|---|---|---|
| 5,462,113 | | 10/1995 | Wand . | |
| 5,630,326 | * | 5/1997 | Nishishita et al. | 165/176 X |
| 5,794,691 | * | 8/1998 | Evans et al. | 165/167 X |

FOREIGN PATENT DOCUMENTS

| | | | | |
|---|---|---|---|---|
| 2748224 | | 5/1978 | (DE) . | |
| 4403144 | | 8/1995 | (DE) . | |
| 0611941 | | 8/1994 | (EP) | 165/167 |
| 0742418 | | 11/1996 | (EP) . | |
| 62-131196 | | 6/1987 | (JP) . | |
| 3-271697 | * | 12/1991 | (JP) | 165/167 |
| 4-73595 | | 3/1992 | (JP) . | |
| 127970 | | 4/1950 | (SE) . | |
| 467275 | | 6/1992 | (SE) . | |
| 502638 | | 11/1995 | (SE) . | |
| 504868 | | 5/1997 | (SE) . | |
| 714131 | | 2/1980 | (SU) . | |
| 00810 | | 1/1995 | (WO) | 165/167 |
| 15797 | * | 5/1997 | (WO) | 165/167 |

* cited by examiner

*Primary Examiner*—Leonard Leo
(74) *Attorney, Agent, or Firm*—Fish & Richardson P.C.

(57) ABSTRACT

The present invention concerns a plate heat exchanger for at least two heat exchanging fluids. The heat exchanger is permanently joined and includes at least one core of plates with corrugated heat exchanging plates (1–4) creating plate interspaces between one another, at least two end plates (5) as well as inlet devices (6) and outlet devices (6) for the heat exchanging fluids. At least one of the end plates (5) is equipped with at least one port hole communicating with an inlet channel or an outlet channel. At least one of the mentioned inlet devices (6) and outlet devices (6) has both a connection part (7) equipped with a channel and a transition part (8) with an envelope surface and equipped with a channel. An intersectional line between an imaginary elongation of the mentioned envelope surface in the direction of the generatrix for the envelope surface in every point of contact between the envelope surface and the end plate (5) on the one hand and a plane having contact areas within the plate interspaces between the two heat exchanging plates (1,2) that are closest to the transition part (8) in the core of plates on the other hand circumscribes a plurality of connecting points (10) between the mentioned two heat exchanging plates (1, 2).

15 Claims, 3 Drawing Sheets

PLATE HEAT EXCHANGER

FIELD OF THE INVENTION

The present invention concerns a plate heat exchanger for at least two heat exchanging fluids which heat exchanger is permanently joined and comprises at least one core of plates with corrugated heat exchanging plates creating plate interspaces between each other, at least two end plates as well as inlet devices and outlet devices for the heat exchanging fluids.

BACKGROUND OF THE INVENTION

Permanently joined plate heat exchangers are used to an increasing extent. The joining together may be done by brazing but also welding and gluing are used. At a pressure overloading a permanently joined plate heat exchanger leakage will arise and the leakage is generally located to the port areas and/or the circumferential areas of the heat exchanging plates in connection to the inlet and outlet channels. The plate heat exchanger has within the port areas of the plates relatively large projected areas without connecting joints between the heat exchanging plates. Upon these areas forces from pipe loads and fluid pressure are acting. The joints which are situated closest to the port areas of the plates run the risk of being over-loaded and torn up.

U.S. Pat. No. 5,462,113 shows a plate heat exchanger for three fluids. The heat exchanger comprises a core of plates with heat exchanging plates, end plates and inlet devices and outlet devices for the heat exchanging fluids. The attachment of the end plate 12 to the extra sealing plate 16 is wide in comparison with the port channel for the heat exchanging fluid R1 and will probably contribute to an increased resistance to pressure load. The resistance may still be improved.

SUMMARY OF THE INVENTION

The purpose of the invention is to create a stronger permanently joined plate heat exchanger for at least two heat exchanging fluids. The invention thus comprises a plate heat exchanger for at least two heat exchanging fluids which heat exchanger is permanently joined and contains at least one core of plates with corrugated heat exchanging plates creating plate interspaces between each other, at least two end plates as well as inlet devices and outlet devices for the heat exchanging fluids. Each one of the heat exchanging plates is equipped with at least four port holes creating an inlet channel and an outlet channel through the core of plates for each one of the fluids. At least one of the end plates is equipped with at least one port hole in communication with an inlet channel or an outlet channel. The inlet channels and the outlet channels for a first and a second fluid, respectively, are in fluid communication with a first and a second set of plate interspaces, respectively.

At least one of the mentioned inlet devices and outlet devices comprises both a connection part equipped with a channel and a transition part with an envelope surface and equipped with a channel, the channel in the transition part fluid tightly connecting the channel in the connection part with one of the port holes in one of the end plates. An intersectional line between an imaginary elongation of the mentioned envelope surface in the direction of the generatrix for the envelope surface in every point of contact between the envelope surface and the end plate 5 on one hand and a plane comprising contact areas in the plate interspaces between the two heat exchanging plates that are closest to the transition part in the core of plates on the other hand circumscribes a plurality of connecting points between the mentioned heat exchanging plates.

The present form of execution of a heat exchanger shows due to the wide attachment to the end plate of the transition part in comparison with the port channel a larger pressure durability than before in this exposed area.

DETAILED DESCRIPTION

Figure 1:
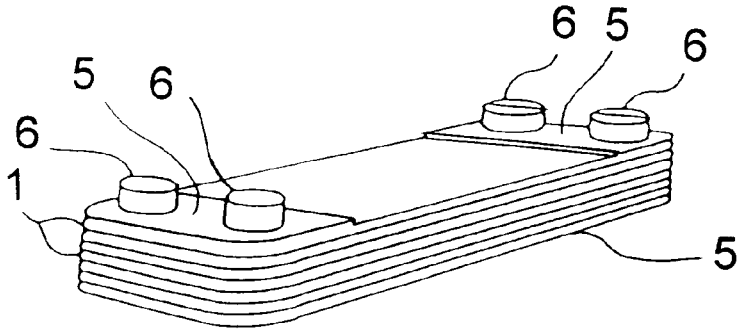
FIG. 1 shows in perspective view and in principle a permanently joined plate heat exchanger according to the invention for two heat exchanging fluids.

The plate heat exchanger according to the invention in FIG. 1 is shown in principle and comprises a core of plates with heat exchanging plates 1, end plates 5 and inlet devices 6 and outlet devices 6 for two heat exchanging fluids.

Figure 2:
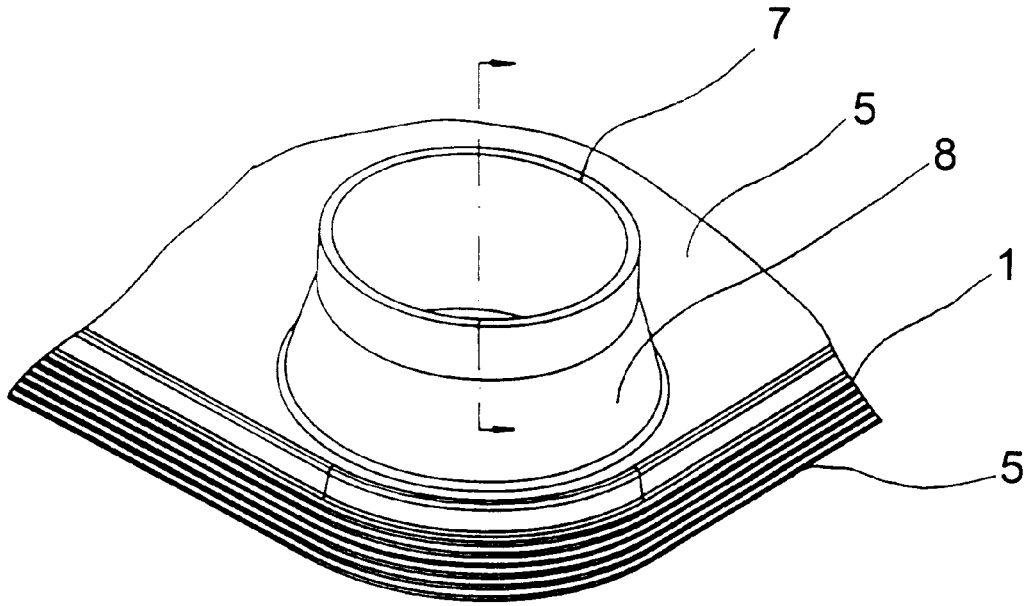
FIG. 2 shows in a perspective view a part of a permanently joined plate heat exchanger according to the invention whereby only one inlet or outlet device and the closest to this device situated part of the heat exchanger are shown.

FIG. 2 shows a part of the plate heat exchanger according to the invention. The figure shows a core of plates with heat exchanging plates 1, end plates 5 as well as an inlet device or an outlet device for a heat exchanging fluid, the inlet or outlet device comprising a connection part 7 and a transition part 8.

Figure 3A:
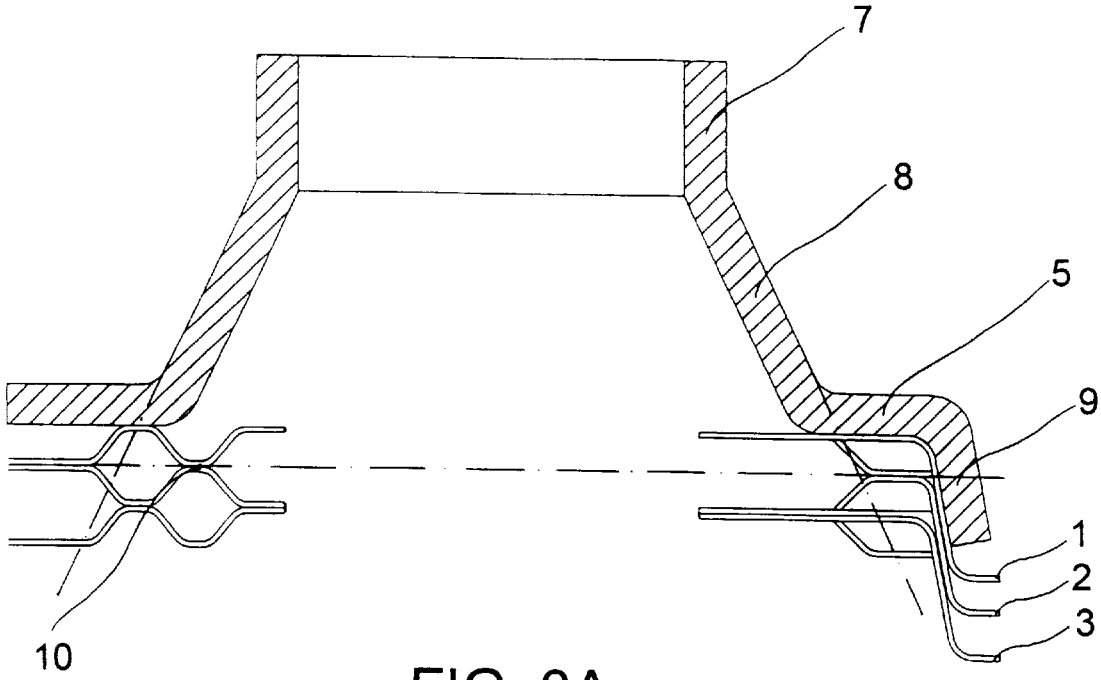
FIGS. 3*a* and 3*b* show in a cross-section the inlet or outlet device, the end plate and four of the heat exchanging plates in the core of plates according to FIG. 2.
Figure 3B:
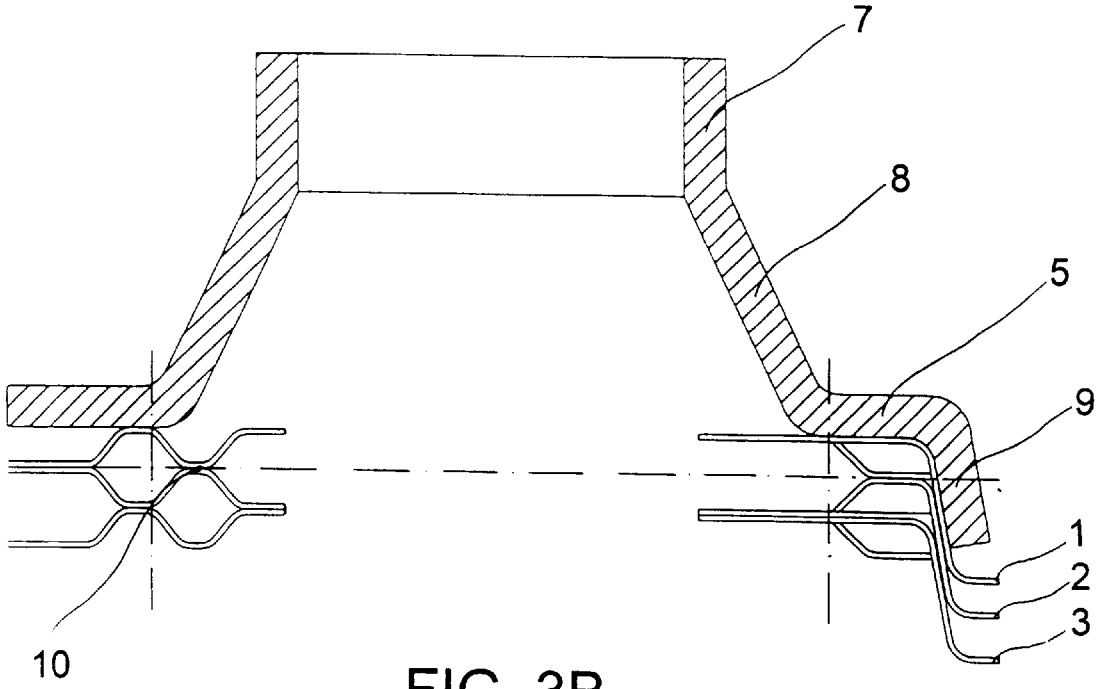
Figure 3C:
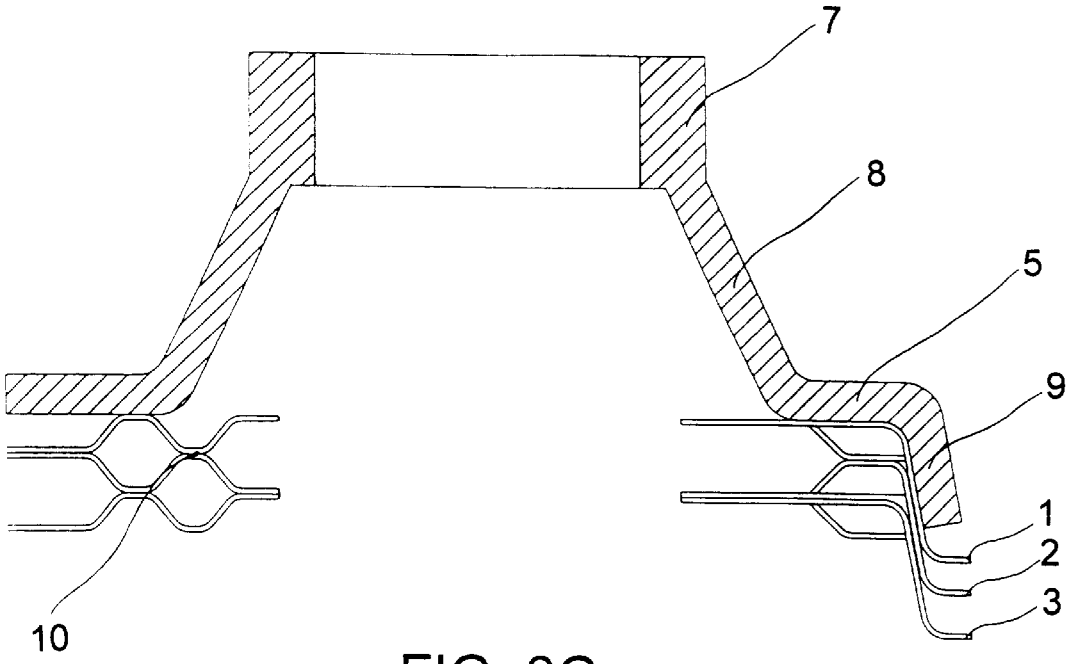
FIGS. 3*c* and 3*d* show in cross-section the inlet or outlet device, the end plate and four of the heat exchanging plates in the core of plates according to two alternative embodiments.
Figure 3D:
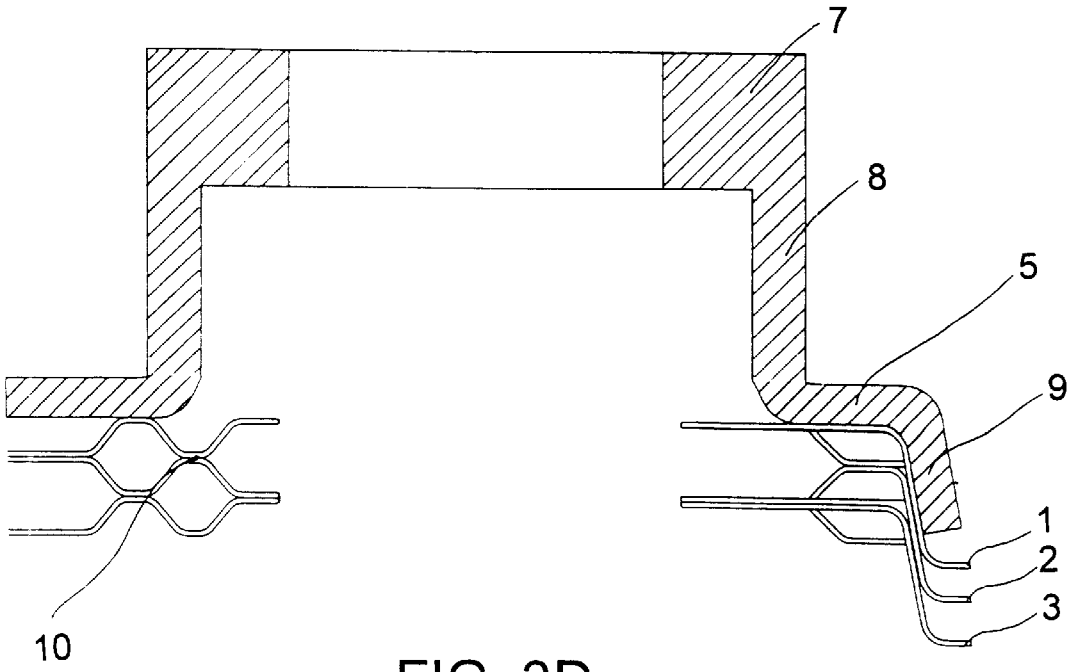

How the construction appears in cross-section is evident from FIGS. 3*a* and 3*b* where for the sake of simplicity only three heat exchanging plates 1–3 have been included. The core of plates may of course be executed in the wished thickness with the wished amount of heat exchanging plates due to the effect need, the space which is available for the installation etc. The construction according to FIGS. 3*a* and 3*b* however differs from the one according to FIG. 2 in such a way that the transition part 8 in FIG. 3 has been executed in one piece with the end plate 5 while the transition part 8 in FIG. 2 afterwards has been added to the end plate 5.

The connection part 7 is equipped with an inner channel and aimed at being connected to a pipe system in a plant of some kind. The transition part 8, also this one equipped with an inner channel, fluid tightly connects the channel within the connection part 7 with a port hole in an end plate 5. The transition part 8 may be executed in one piece with the connection part 7 and/or, as mentioned above, with the end plate 5.

An intersectional line between an imaginary elongation of the envelope surface of the transition part 8 in the direction of the generatrix of the envelope surface in every point of contact between the envelope surface and the end plate 5 on one hand and a plane comprising contact areas within the plate interspace between the two heat exchanging plates 1, 2 situated closest to the transition part 8 in the core of plates on the other hand (see FIG. 3*a*) circumscribes a plurality of connecting points 10 between the mentioned two heat exchanging plates 1, 2. As a further accentuation of the determinations an intersectional line between an imaginary elongation perpendicular to the plates 1–5 of the envelope surface for the transition part 8 on one hand and the mentioned plane comprising contact areas in the plate interspace between the two heat exchanging plates 1, 2 closest to the transition part in the core of plates on the other hand (see FIG. 3*b*) may circumscribe a plurality of connecting points 10 between the mentioned heat exchanging plates 1, 2. In connection to the elongation of the envelope surface one takes as a starting point a contact line between the mentioned envelope surface and the end plate 5.

The mentioned intersectional line may, depending on the plate size, circumscribe 2–200, preferably 3–100 and most preferred 5–50 connecting points 10. The circumscribed connecting points 10 are peripherally situated around the inlet or outlet channel and are present mainly evenly distributed over the present plate areas within an undivided circular sector with a central angle of at least 90 degrees, preferably more than 225 degrees and most preferred 360 degrees where the centre of the circle coincides with the centre of the inlet or outlet channel. The mentioned connecting points 10 may be brazing joints but also welding and gluing may, as mentioned earlier, be used as a method connection.

All the inlet devices 6 and outlet devices 6 may be attached to the same end plate 5. If this is not the case the inlet device 6 for a first fluid and the outlet device 6 for a second fluid for example may instead be attached to a first end plate 5 and the inlet device 6 for the mentioned second fluid and the outlet device 6 for the mentioned first fluid may be attached to a second end plate 5.

Each one of the present end plates 5 may possess an area which is smaller than half the area for one of the heat exchanging plates 1–4 in the core of plates whereby the area without regard to the area enlargement due to corrugations is meant. Two or more end plates of the kind described may be mounted in the same end of the core of plates but in different ends and/or corners of the closest situated heat exchanging plate. The end plates 5 may fluid tightly connect to the core of plates and in the outer boarders of the core show edge areas 9 at an angle to the main plane of extension for the plates for contacting and attachment to similar edge areas upon the closest situated heat exchanging plate 1–4 in the core of plates.

The connection part 7 may be cylindrical and have a larger wall thickness than the associated transition part 8. The transition part 8 may be executed in the form of a channel equipped and thus hollow truncated cone (see FIGS. 3*a*, 3*b* and 3*c*)or in the form of a channel equipped and thus hollow cylinder(see FIG. 3*d*). The transition part 8 however does not need to be rotation symmetrical. The transition part 8, the end plate 5 and as a consequence the flange-like edge area 9 are, especially in a corner of the plate heat exchanger, with advantage of mainly the same thickness.

The dimensions for pipes and pieces of joint are standardized. The presence of the transition part 8 makes the preservation of the up to now mainly used dimensions and positions for the connection parts 7 possible at the same time as the contact area for the attachment of inlet devices 6 and/or outlet devices 6 to the end plate 5 is moved radially outwards, i.e. "past" a number of in relation to the port channels peripherally situated connecting points 10. The strains upon these exposed connecting points 10 between plates hereby diminish and the so called tearing forces are neutralized. The thickness of the goods in the end plate 5 may be diminished in comparison with prior art for the same demand concerning the pressure load as before. Hereby also the susceptibility of the construction to thermal cycles and fatigue will diminish.

By the dividing up of the inlet device 6 and the outlet device 6 into a connection part 7 and a transition part 8 also the advantage is achieved that the connection parts 7 may be mounted afterwards after the plate heat exchanger with the transition part 8 have been mounted and have passed the brazing furnace. Hereby space within the furnace is saved since this may be filled more effectively with more cores of heat exchangers at a time, induction brazing may be used and the material within the connecting parts 7 may afterwards be chosen freely.

If instead connection part/parts 7, transition part/parts 8 and the end plate 5 are arranged in one piece by pressing of a plane plate especially low manufacturing costs are achieved.

The invention is not restricted to the forms of execution shown here but may be varied in accordance with the following patent claims.

What is claimed is:

1. A plate heat exchanger for at least two heat exchanging fluids, said heat exchanger being permanently joined and comprising at least one core of corrugated heat exchanging plates (1–4), said plates forming at least first and second sets of plate interspaces between one another, at least two end plates (5) and inlet devices (6) and outlet devices (6) for the at least two heat exchanging fluids, each one of the heat exchanging plates (1–4) having at least four port holes, thus forming an inlet channel and an outlet channel through the core of plates for each of the at least two heat exchanging fluids, at least one of the end plates (5) being equipped with at least one of the port holes, each said at least one of the port holes communicating with one of the inlet channels or one of the outlet channels and the inlet channels and the outlet channels for a first and a second of said at least two heat exchanging fluids, respectively, being in fluid communication with the first and the second sets, respectively, of plate interspaces wherein at least one of the inlet devices (6) and outlet devices (6) comprises both a connection part (7) equipped with a channel and a transition part (8) with an envelope surface and equipped with a channel, the channel in the transition part (8) fluid tightly connecting the channel in the connection part (7) with the at least one of the port holes in one of the end plates (5), the transition part (8) being made in one piece with the end plates (5), an intersectional line between an imaginary elongation of the envelope surface, in the direction of a generatrix for the envelope surface in every point of contact between the envelope surface and the end plate (5) on one hand and a plane comprising areas of contact in the plate interspace between two adjacent heat exchanging plates (1, 2) that are closest to the transition part (8) in the core of plates on the other hand circumscribing a plurality of connecting points (10) between the two adjacent heat exchanging plates (1, 2) and the inlet device (6) for the first fluid and the outlet device (6) for the second fluid are connected to a first end plate (5) and the inlet device (6) for the second fluid and the outlet device (6) for the first fluid are connected to a second end plate (5), each one of the first and second end plates (5) showing a surface area which is less than half of the surface area of one of the heat exchanging plates (1–4) in the core of plates.

2. A plate heat exchanger according to claim 1 in which the intersectional line between the imaginary elongation, starting from a line of contact between the envelope surface and the end plate (5) in a direction which is at right angles with the plates (1–5), of the envelope surface of the transition part (8) on one hand and the plane comprising surfaces of contact in the plate interspace between the heat exchanging plates (1, 2) that are closest to the transition part (8) in the core of plates on the other hand circumscribes a plurality of connecting points (10) between the two adjacent heat exchanging plates (1,2).

3. A plate heat exchanger according to claim 1 in which the intersectional line circumscribes 2–200 connecting points (10).

4. A plate heat exchanger according to claim 3 in which the intersectional line circumscribes 3–100 connecting points (10).

5. A plate heat exchanger according to claim 4 in which the intersectional line circumscribes 5–50 connecting points (10).

6. A plate heat exchanger according to claim 1 in which the intersectional line circumscribes connecting points (10) which are present mainly evenly distributed over the existing plate areas around the inlet channel or the outlet channel in an undivided circular sector with a central angle of at least 90 degrees, where the center of the circle coincides with the center of the inlet channel or the outlet channel.

7. A plate heat exchanger according to claim 6 in which the central angle is more than 225 degrees.

8. A plate heat exchanger according to claim 7 in which the central angle is 360 degrees.

9. A plate heat exchanger according to claim 1 in which the connecting points (10) are brazing joints.

10. A plate heat exchanger according to claim 1 in which the transition part (8) is executed in one piece with the associated connection part (7).

11. A plate heat exchanger according to claim 1 in which the end plates (5) are both mounted in the same end of the core of plates but in different ends of a top-most situated heat exchanging plate (1).

12. A plate heat exchanger according to claim 1 in which the end plates (5) fluid tightly connect to the core of plates and in their outer edges show edge areas (9) at an angle to the main plane of extension of the plates (1–5) for contacting and permanent attachment to similar edge areas on a top-most situated heat exchanging plate (1) in the core of plates.

13. A plate heat exchanger according to claim 1 in which the connection part (7) is cylindrical and has a larger wall thickness than the associated transition part (8).

14. A plate heat exchanger according to claim 1 in which the transition part (8) has the form of a hollow truncated cone.

15. A plate heat exchanger according to claim 1 in which the transition part (8) has the form of a hollow cylinder.

* * * * *